US011905062B2

(12) United States Patent
Tan et al.

(10) Patent No.: US 11,905,062 B2
(45) Date of Patent: Feb. 20, 2024

(54) CUSHION CONVEYING DEVICE AND METHOD, AND CUSHION ROLLING PACKAGING APPARATUS AND METHOD

(71) Applicant: Guangzhou Lianrou Machinery & Equipment Co., Ltd., Guangdong (CN)

(72) Inventors: Zhiming Tan, Guangdong (CN); Jie Liang, Guangdong (CN); Zhiliang Tan, Guangdong (CN)

(73) Assignee: Guangzhou Lianrou Machinery & Equipment Co., Ltd., Guangdong (CN)

( * ) Notice: Subject to any disclaimer, the term of this patent is extended or adjusted under 35 U.S.C. 154(b) by 321 days.

(21) Appl. No.: 17/593,116

(22) PCT Filed: May 24, 2019

(86) PCT No.: PCT/CN2019/088294
§ 371 (c)(1),
(2) Date: Sep. 9, 2021

(87) PCT Pub. No.: WO2020/211157
PCT Pub. Date: Oct. 22, 2020

(65) Prior Publication Data

US 2022/0144462 A1 May 12, 2022

(30) Foreign Application Priority Data

Apr. 15, 2019 (CN) ..... 201910299930.4

(51) Int. Cl.
*B65B 9/02* (2006.01)
*B65B 35/22* (2006.01)
(Continued)

(52) U.S. Cl.
CPC ..... *B65B 9/02* (2013.01); *B65B 35/22* (2013.01); *B65B 35/24* (2013.01); *B65B 51/10* (2013.01);
(Continued)

(58) Field of Classification Search
None
See application file for complete search history.

(56) References Cited

U.S. PATENT DOCUMENTS

2013/0067862 A1 3/2013 Oh

FOREIGN PATENT DOCUMENTS

CN 203975374 U 12/2014
CN 108423218 A * 8/2018 ..... B65B 11/02
(Continued)

OTHER PUBLICATIONS

International Search Report and Written Opinion, PCT/CN2019/088294, English Translation.
(Continued)

*Primary Examiner* — Tanzim Imam
(74) *Attorney, Agent, or Firm* — WELSH FLAXMAN & GITLER LLC

(57) ABSTRACT

Disclosed are a cushion conveying device and method, and a cushion rolling packaging apparatus and method. The cushion conveying device includes a frame, a conveying platform, a pressing mechanism and a folding mechanism. At least one gap area is provided on the conveying platform. The pressing mechanism is movable back and forth to contact and press at least one part of the cushion on the conveying platform. The folding mechanism includes at least one folding member movable back and forth to pass through the gap area, the folding member is capable of extending out of the gap area to abut against the cushion on the conveying platform, so as to turn up and fold the cushion.

18 Claims, 12 Drawing Sheets

(51) Int. Cl.

| | |
|---|---|
| ***B65B 35/24*** | (2006.01) |
| ***B65B 51/10*** | (2006.01) |
| ***B65B 61/10*** | (2006.01) |
| ***B65B 63/02*** | (2006.01) |
| ***B65B 63/04*** | (2006.01) |

(52) U.S. Cl.
CPC ..... *B65B 61/10* (2013.01); *B65B 63/02* (2013.01); *B65B 63/04* (2013.01)

(56) References Cited

FOREIGN PATENT DOCUMENTS

| | | | | | |
|---|---|---|---|---|---|
| CN | 108423218 | A | | 8/2018 | |
| CN | 108584038 | A | | 9/2018 | |
| CN | 207943636 | U | * | 10/2018 | ..... B65B 63/04 |
| CN | 207943636 | U | | 10/2018 | |
| JP | 2777624 | A | | 6/1996 | |

OTHER PUBLICATIONS

The State Intellectual Property Office of People's Republic of China, CN App. No. 201910299930.4, First Office Action, English Translation, dated Dec. 6, 2019.
The State Intellectual Property Office of People's Republic of China, CN App. No. 201910299930.4, Second Office Action, English Translation, dated Apr. 26, 2020.

* cited by examiner

CUSHION CONVEYING DEVICE AND METHOD, AND CUSHION ROLLING PACKAGING APPARATUS AND METHOD

CROSS-REFERENCE TO RELATED APPLICATION

This application is a national stage filing under 35 U.S.C. § 371 of international application number PCT/CN2019/088294, filed May 24, 2019, which claims priority to Chinese patent application No. 201910299930.4 filed Apr. 15, 2019. The contents of these applications are incorporated herein by reference in their entirely.

TECHNICAL FIELD

The disclosure relates to the technical field of cushion packaging apparatus, in particular to a cushion conveying device and method, and a cushion rolling packaging apparatus and method.

BACKGROUND

Mattresses are inconvenient to transport and store because of their huge size. In order to improve the efficiency of transport and storage, mattresses and mattress products are usually compressed and rolled into a cylindrical shape, or folded in half and then rolled into a cylindrical shape to reduce the occupied space during transport and storage.

In the traditional technology, mattresses and mattress products are usually folded in half by hand, which is labor intensive and poor in quality stability. In order to improve efficiency and realize automatic production, there are also apparatuses in the existing technology for automatically folding mattresses and mattress products. For example, patent CN 208344688U discloses a device for n automatically folding a mattress, which includes a conveying mechanism, a folding turnover mechanism and a rotary conveying mechanism which are arranged adjacently in sequence. The mattress is pressed down and folded in half by the folding turnover mechanism, and then the folded mattress is turned over for 90 degrees from bottom to top and transferred to the rotary conveying mechanism which then horizontally rotates the mattress. The whole process of conveying, folding and rotating the mattress needs to be completed in different mechanisms and stations, that is, different mechanisms and positions need to be configured, resulting in complex overall structure and huge volume. In addition, the mattress is inserted between clamping plates from top to bottom through the folding turnover mechanism, and then turned over for 90 degrees to be sent out. The folding process of the mattress is time-consuming and cumbersome, and the mattress is easily stuck between the clamping plates and difficult to be sent out, resulting in high failure rate and inconvenient maintenance.

SUMMARY

The disclosure is intended to address at least one of the technical problems in the existing technology by providing a cushion conveying device which has a compact structure and stable operation and a cushion rolling packaging apparatus with high efficiency, and further providing a fast and stable cushion conveying method for folding or rotating a cushion and a cushion rolling packaging method with high packaging efficiency.

According to a first aspect of the disclosure, there is provided a cushion conveying device, including: a frame; a conveying platform arranged on the frame for conveying a cushion, where at least one gap area is provided on the conveying platform; a pressing mechanism arranged above the conveying platform or on one side of the conveying platform, where the pressing mechanism is movable back and forth to contact and press at least one part of the cushion on the conveying platform; and a folding mechanism arranged below the conveying platform, where the folding mechanism includes at least one folding member movable back and forth to pass through the gap area, the folding member is capable of extending out of the gap area to abut against the cushion on the conveying platform, so as to turn up and fold the cushion.

The cushion conveying device at least has the following beneficial effects. The cushion, when conveyed to the conveying platform, is folded in an overturning mode by the pressing mechanism and the folding mechanism cooperatively, so that the folding action is simple and fast. The folded cushion is directly conveyed to the next process through the conveying platform, without additional adjustment to the cushion, such as overturning the cushion, so that the operation is stable and reliable. Moreover, the pressing mechanism and the folding mechanism are respectively arrange above and below the conveying platform, so that the space is fully utilized, the structure is compact, and the occupied area is small.

In the cushion conveying device according to the first aspect of the disclosure, the pressing mechanism includes at least one pressing member and a driving component for driving the pressing member to translate and/or rotate, and the driving component is capable of driving the pressing member to separate from the cushion after the cushion is turned up and folded.

In the cushion conveying device according to the first aspect of the disclosure, the pressing mechanism includes a slide rail arranged on the frame and a slide base slidably connected with the slide rail, the pressing member is hinged with the slide base, and the driving component is capable of driving the slide base to translate relative to the slide rail and/or driving the pressing member to rotate relative to the slide base.

In the cushion conveying device according to the first aspect of the disclosure, the pressing member includes a plurality of pressing plates and/or rollers which are arranged at intervals.

In the cushion conveying device according to the first aspect of the disclosure, the pressing member is configured to press half of the cushion on the conveying platform.

In the cushion conveying device according to the first aspect of the disclosure, the folding member includes a turning plate or rod swingable to pass through the at least one gap area.

In the cushion conveying device according to the first aspect of the disclosure, a rotating mechanism is further included, which includes a support plate arranged in the gap area, a lifting member capable of driving the support plate to move up and down, and a rotating member for driving the support plate to rotate.

In the cushion conveying device according to the first aspect of the disclosure, the support plate is cross-shaped or window-shaped.

In the cushion conveying device according to the first aspect of the disclosure, a centering mechanism is further included, which includes centering members respectively arranged on left and right sides of the conveying platform, where the centering members on both sides are movable towards each other to push the cushion to a middle position of the conveying platform.

In the cushion conveying device according to the first aspect of the disclosure, the centering members include retaining rods movable back and forth in the at least one gap area.

In the cushion conveying device according to the first aspect of the disclosure, the retaining rods are movable up and down so as to extend or retract relative to the conveying platform.

In the cushion conveying device according to the first aspect of the disclosure, the conveying platform includes a plurality of rollers arranged in sequence, and the gap area is formed by a gap between adjacent rollers.

In the cushion conveying device according to the first aspect of the disclosure, the conveying platform includes a plurality of conveyor belts arranged in sequence, and the gap area is formed by a gap between adjacent conveyor belts.

According to a second aspect of the disclosure, there is provided a cushion conveying method, implemented by the cushion conveying device according to the first aspect, and including:

conveying a cushion into the conveying platform;

pressing by the pressing mechanism at least one part of the cushion;

turning up by the folding mechanism the other part of the cushion to turn up and fold the cushion;

conveying the cushion out by the conveying platform.

In the cushion conveying method according to the second aspect of the disclosure, further including: pushing the cushion to a middle position after turning up and folding the cushion.

In the cushion conveying method according to the second aspect of the disclosure, the conveying a cushion into the conveying platform includes: conveying the cushion into the conveying platform with a length direction of the cushion being perpendicular to a conveying direction of the cushion.

According to a third aspect of the disclosure, there is provided a cushion conveying method, implemented by the cushion conveying device according to the first aspect, and including:

conveying a cushion into the conveying platform;

rotating by the rotating mechanism the cushion for 90 degrees;

conveying the cushion out by the conveying platform.

In the cushion conveying method according to the third aspect of the disclosure, the conveying a cushion into the conveying platform includes: conveying the cushion into the conveying platform with a length direction of the cushion being perpendicular to a conveying direction of the cushion.

According to a fourth aspect of the disclosure, there is provided a cushion rolling packaging apparatus, including the cushion conveying device according to the first aspect.

The cushion rolling packaging apparatus at least has the following beneficial effects. By folding or rotating the cushion by the cushion conveying device, the folding action is simple and fast, and the cushion can be rolled and packaged in the form of a production line to form a cylindrical shape, so as to reduce the occupied space of the cushion during transportation and storage.

The cushion rolling packaging apparatus according to the fourth aspect of the disclosure, a rolling packaging device arranged downstream of the cushion conveying device is further included.

The cushion rolling packaging apparatus according to the fourth aspect of the disclosure, a compression packaging device arranged upstream of the cushion conveying device is further included.

The cushion rolling packaging apparatus according to the fourth aspect of the disclosure, a film covering packaging device arranged upstream of the compression packaging device is further included.

According to a fifth aspect of the disclosure, there is provided a cushion rolling packaging method, implemented by the cushion rolling packaging apparatus according to the fourth aspect, and including:

covering by the film covering packaging device a film on a surface of a cushion, and conveying the cushion to the compression packaging device;

compressing by a compression packaging device the cushion to discharge air, sealing and packaging the cushion in the film, and conveying the cushion to the cushion conveying device;

folding or rotating by the cushion conveying device the cushion, and conveying the cushion to the rolling packaging device;

rolling by the rolling packaging device the cushion into a cylindrical shape and conveying the cushion out of the rolling packaging device.

BRIEF DESCRIPTION OF DRAWINGS

The disclosure will be further explained with reference to accompanying drawings and embodiments.

DETAILED DESCRIPTION

Figure 1:
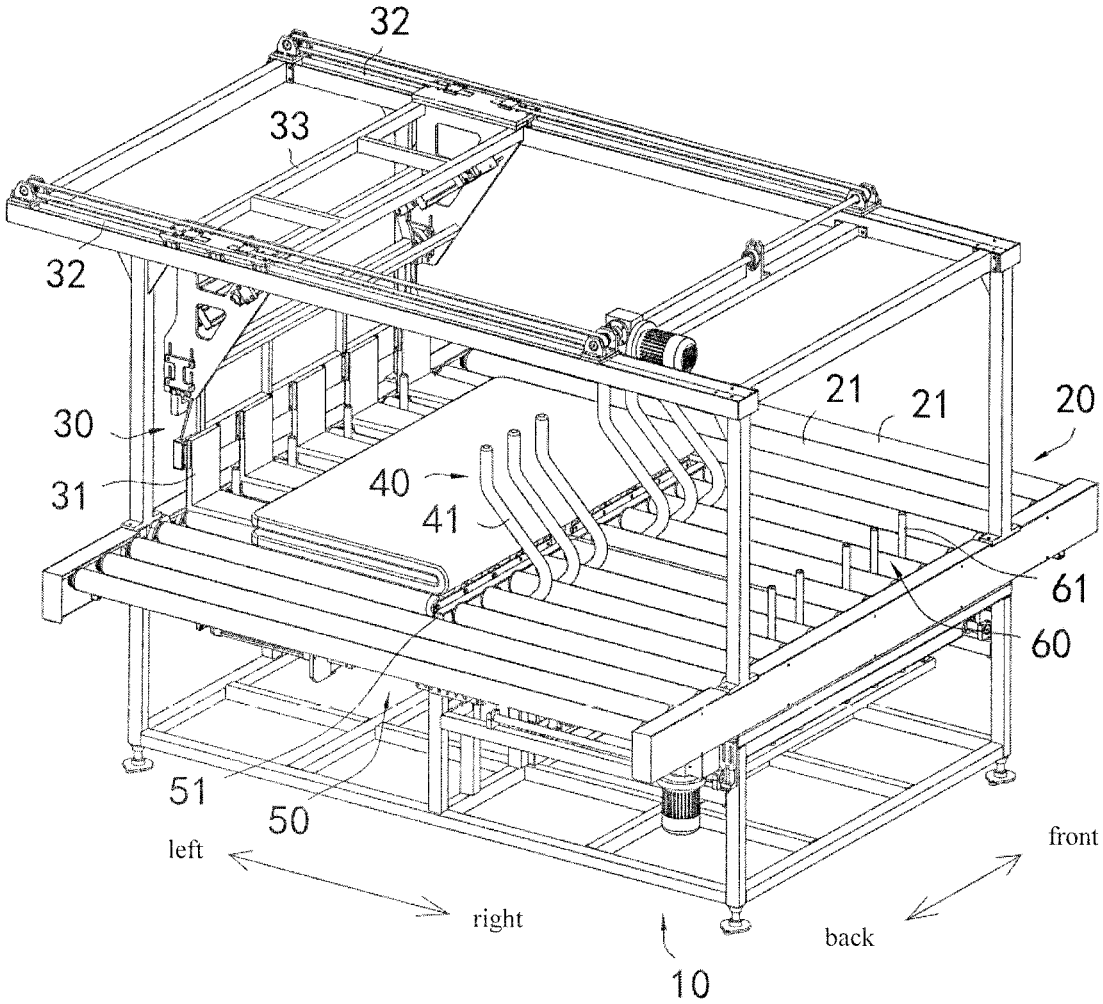
FIG. 1 is a schematic structural diagram of a cushion conveying device according to an embodiment of the disclosure.

This section will describe the embodiments of the disclosure in detail, and some embodiments of the disclosure are shown in the accompanying drawings. The accompanying drawings function as supplementing the description in the text of the specification with figures, so that one can intuitively and vividly understand each technical feature and the overall technical scheme of the disclosure, but it cannot be understood as limiting the scope of protection of the disclosure.

In the description of the disclosure, it should be understood that when it comes to orientation description, such as up, down, front, back, left, right, etc., the orientation or positional relationship is based on the orientation or positional relationship shown in the drawings, which is only for the convenience of describing the disclosure and simplifying the description, but does not indicate or imply that the referred device or element must have a specific orientation, be constructed and operated in a specific orientation, so it cannot be understood as limiting the disclosure.

In the description of the disclosure, "several" means one or more, "a plurality of" means two or more, and "greater than", "less than", "more than", etc. are understood as excluding the number itself, "above", "below", "within", etc. are understood as including the number itself. "First", "second", etc., if referred to, are for the purpose of distinguishing technical features only, but cannot be understood as indicating or implying a relative importance or implicitly indicating the number of technical features indicated or implicitly indicating the precedence of technical features indicated.

In the description of the disclosure, unless otherwise clearly defined, terms such as "arrange", "mount", "connect" should be understood in a broad sense, and those having ordinary skill in the art can reasonably determine the specific meanings of the above terms in the disclosure by combining the specific contents of the technical themes.

In the description of embodiments of the disclosure, the cushion may be made of compressible material which can be compressed and rolled up under the action of external force. For example, the cushion may be a mattress, which may be a spring mattress, an independent bagged spring mattress or a foam sponge mattress, etc. Embodiments of the disclosure are described with respect to the process of folding, rotating and packaging of the mattress.

Referring to FIG. 1, an embodiment of the disclosure provides a cushion conveying device for folding or rotating a mattress to adjust a size or orientation of the mattress, so as to facilitate compression and rolling of the mattress to form a cylindrical shape in subsequent process. The cushion conveying device includes a frame 10, a conveying platform 20, a pressing mechanism 30 and a folding mechanism 40.

The conveying platform 20 is arranged on the frame 10 for conveying the mattress in a conveying direction, which refers to the front-back direction of the conveying platform 20.

In the description of this embodiment, the directional terms "front", "back", "left" and "right" may be understood by referring to the arrows in FIG. 1, and the conveying direction of the mattress in the conveying platform 20 is from "front" to "back".

The conveying platform 20 may use different structural forms to realize mattress moving and conveying. In this embodiment, the conveying platform 20 includes a plurality of rollers 21 which are sequentially spaced apart in the front-back direction, and there is a gap area between every two adjacent rollers 21. Each of the rollers 21 has a top surface for supporting the mattress. When all rollers 21 are driven to rotate synchronously, the mattress can be moved and conveyed.

In some embodiments, the conveying platform 20 may also include a plurality of conveyor belts which are arranged adjacently in the front-back direction, and there is a gap area between every two adjacent conveyor belts. Synchronous operation of the conveyor belts can also move and convey the mattress. It can be understood that the conveying platform 20 may also be formed by combination of rollers and conveyor belts arranged at intervals in the front-back direction.

The pressing mechanism 30 is arranged on the frame 10, and is movable back and forth to contact and press at least one part of the mattress, so as to facilitate the mattress to be turned up and folded. Generally, it is a choice to press half of the mattress, so that the mattress can be folded in half when turned over, thereby minimizing an area of the folded mattress. Back and forth movement is not limited to simple translation or rotation.

Referring to FIG. 1, FIG. 3 to FIG. 11, in this embodiment, the pressing mechanism 30 includes a pressing member 31 and a driving component for driving the pressing member 31 to move back and forth, and the driving component is a common power component such as a cylinder or a motor. In some embodiments, a slide rail 32 is arranged in a left-right direction on the frame 10 above the conveying platform 20. The slide rail 32 is slidably connected with a slide base 33, which is translatable back and forth along a direction of the slide rail 32 when driven by a motor, a chain sprocket transmission mechanism, etc. A bottom of the slide base 33 is hinged with a top of the pressing member 31, forming a hinge axis. The pressing member 31 is rotatable for a predetermined angle about the hinge axis with respect to the slide base 33, that is, swingable up and down about the hinge axis, when driven by components such as a cylinder. The pressing member 31 includes a plurality of L-shaped pressing plates arranged at intervals, and when the pressing member 31 swings down to the lowest point, the pressing plates are just in a horizontal state and press the mattress on the conveying platform 20. After the mattress is turned up and folded in half, the pressing plates are certainly wrapped between the folded mattress with upper and lower layers. By moving the slide base 33 to the left to drive the pressing member 31 to horizontally translate to the left, the pressing plates can be pulled out and separated from the folded mattress without affecting the folded mattress.

Figure 2:
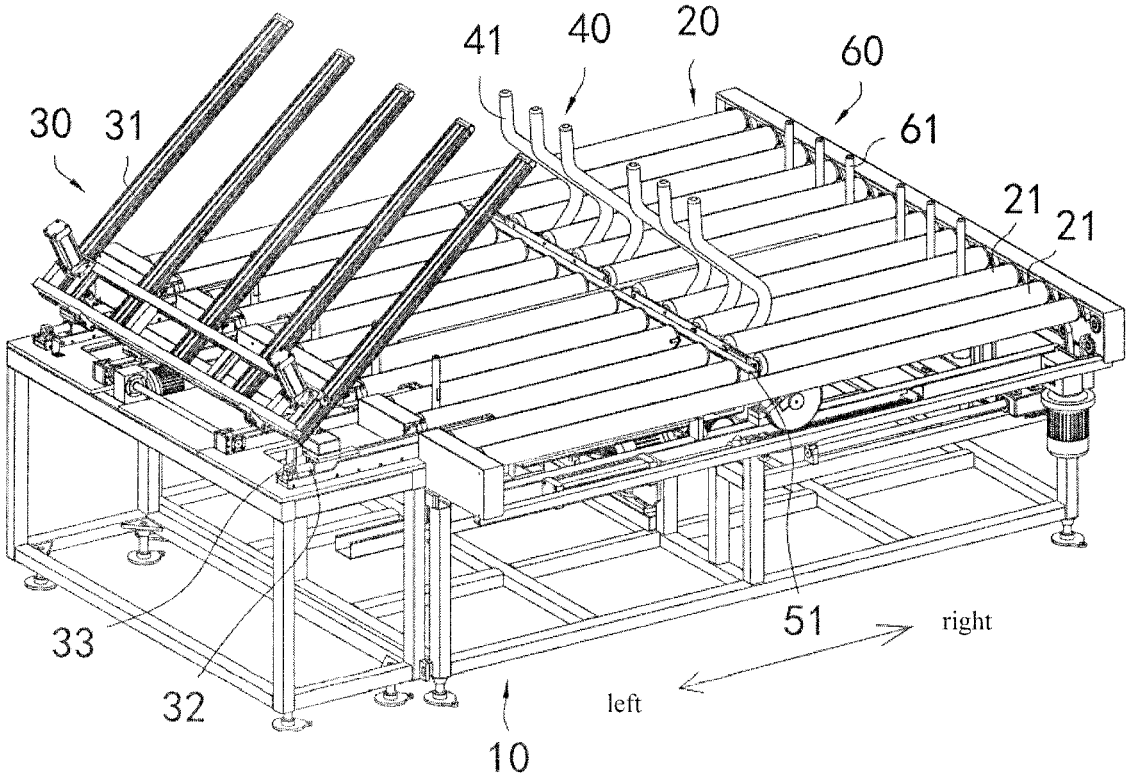
FIG. 2 is a schematic structural diagram of a cushion conveying device according to another embodiment of the disclosure.
Figure 3:
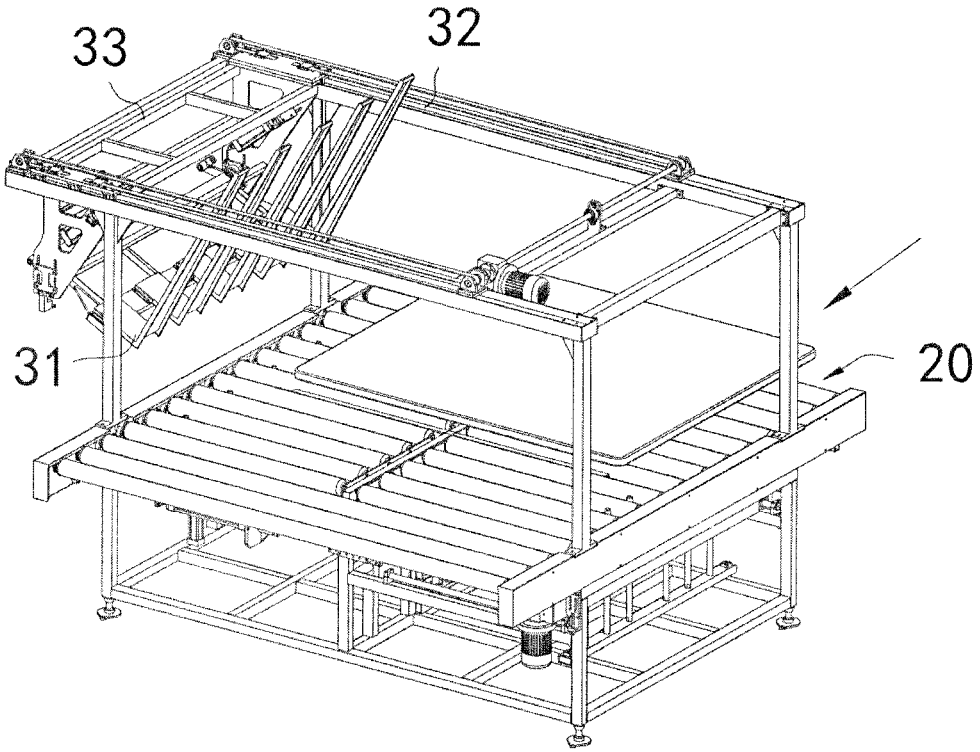
FIG. 3 is a schematic diagram showing a first state in the process of folding a mattress by the cushion conveying device according to an embodiment of the disclosure.
Figure 4:
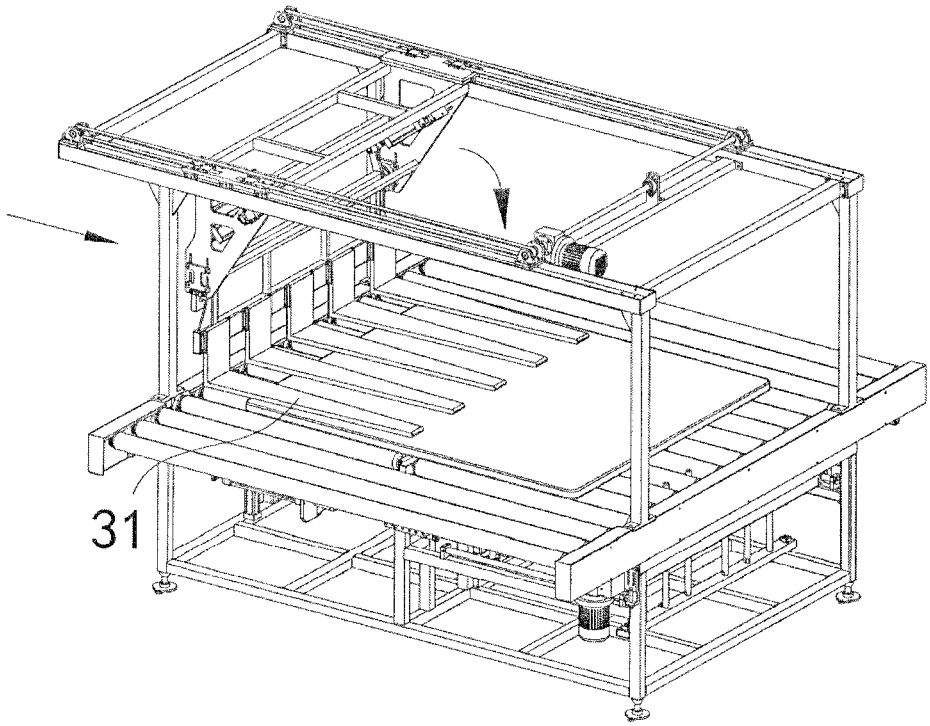
FIG. 4 is a schematic diagram showing a second state in the process of folding the mattress by the cushion conveying device according to an embodiment of the disclosure.
Figure 5:
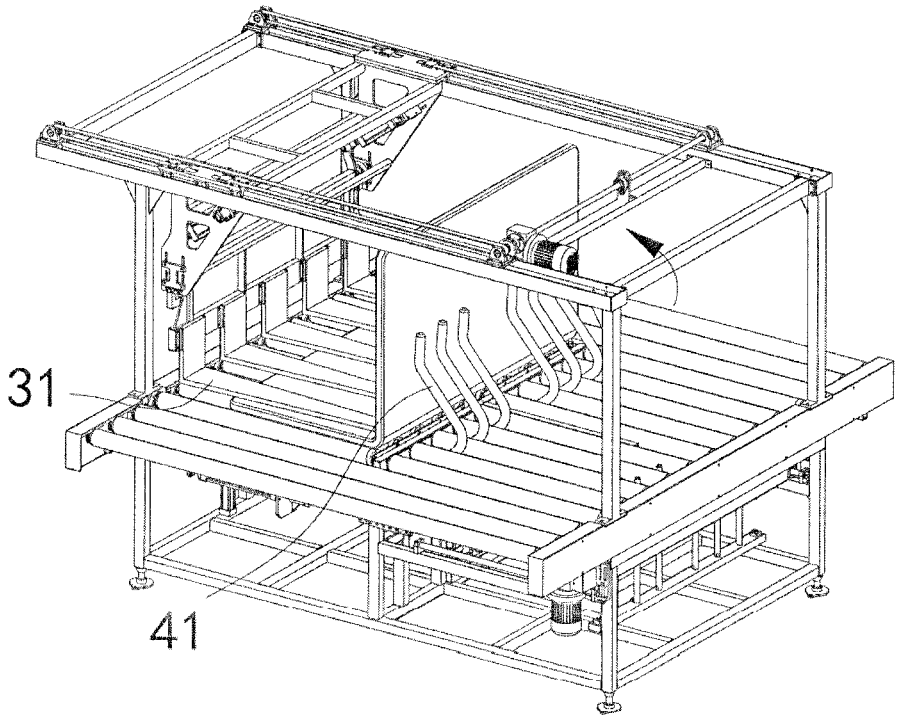
FIG. 5 is a schematic diagram showing a third state in the process of folding the mattress by the cushion conveying device according to an embodiment of the disclosure.
Figure 6:
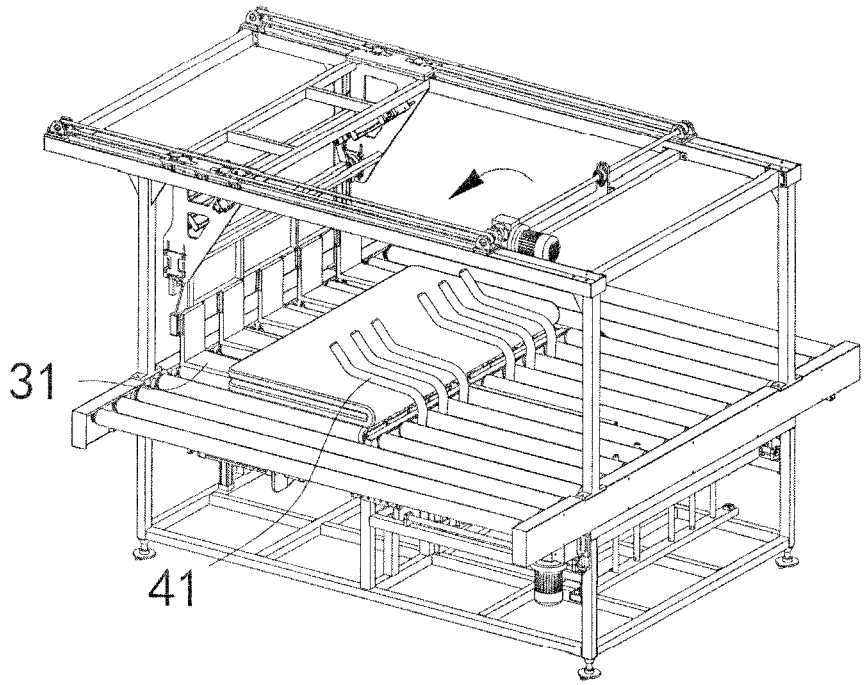
FIG. 6 is a schematic diagram showing a fourth state in the process of folding the mattress by the cushion conveying device according to an embodiment of the disclosure.
Figure 7:
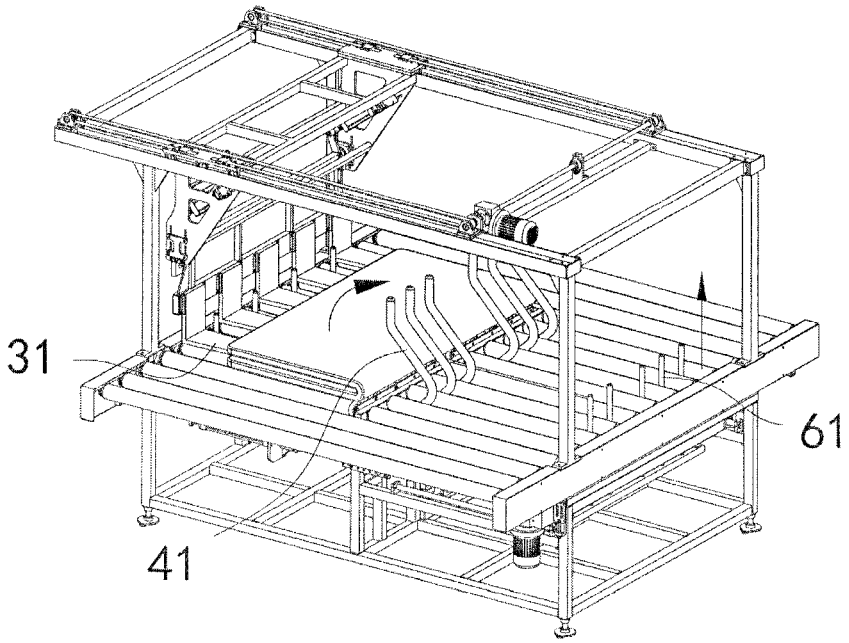
FIG. 7 is a schematic diagram showing a fifth state in the process of folding the mattress by the cushion conveying device according to an embodiment of the disclosure.
Figure 8:
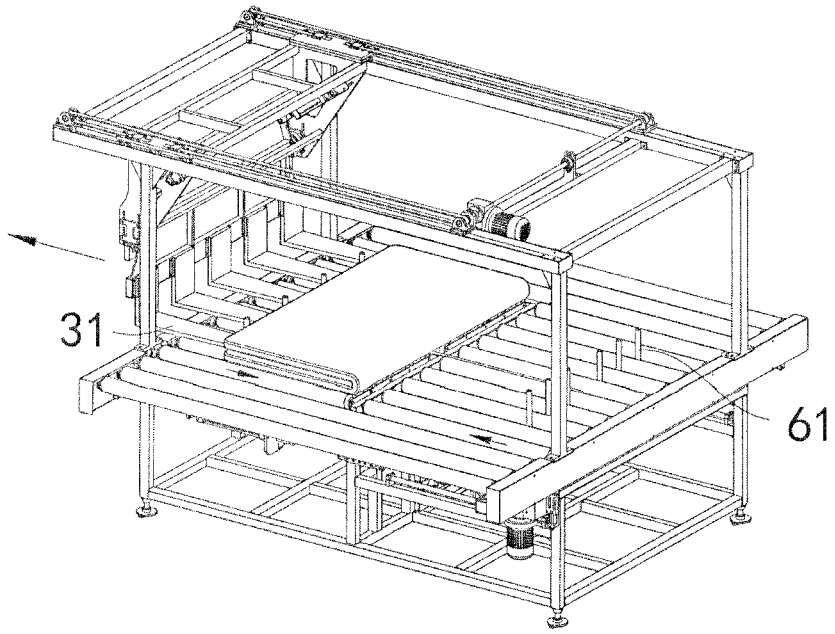
FIG. 8 is a schematic diagram showing a sixth state in the process of folding the mattress by the cushion conveying device according to an embodiment of the disclosure.
Figure 9:
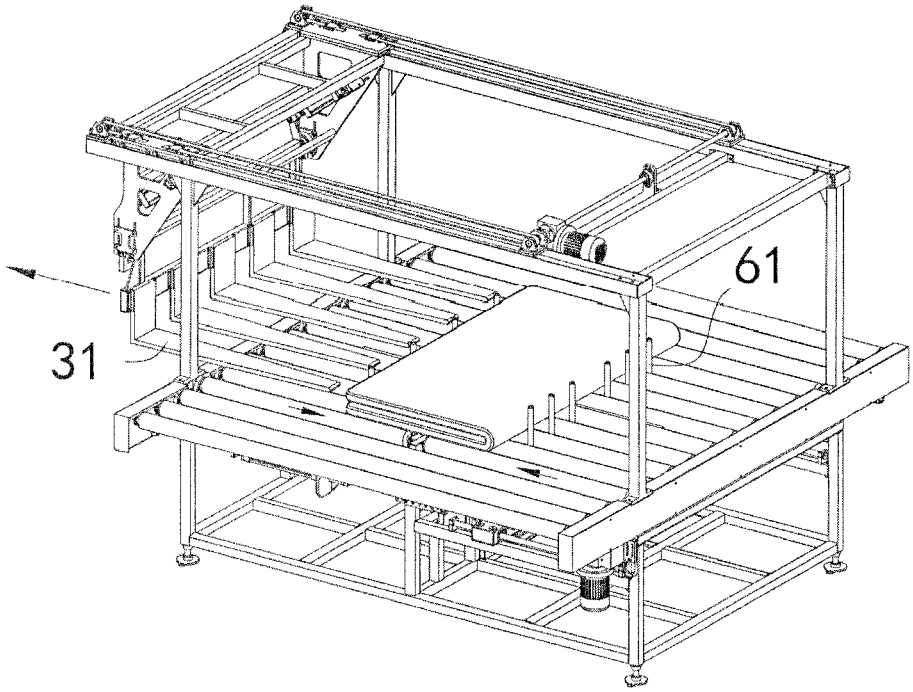
FIG. 9 is a schematic diagram showing a seventh state in the process of folding the mattress by the cushion conveying device according to an embodiment of the disclosure.
Figure 10:
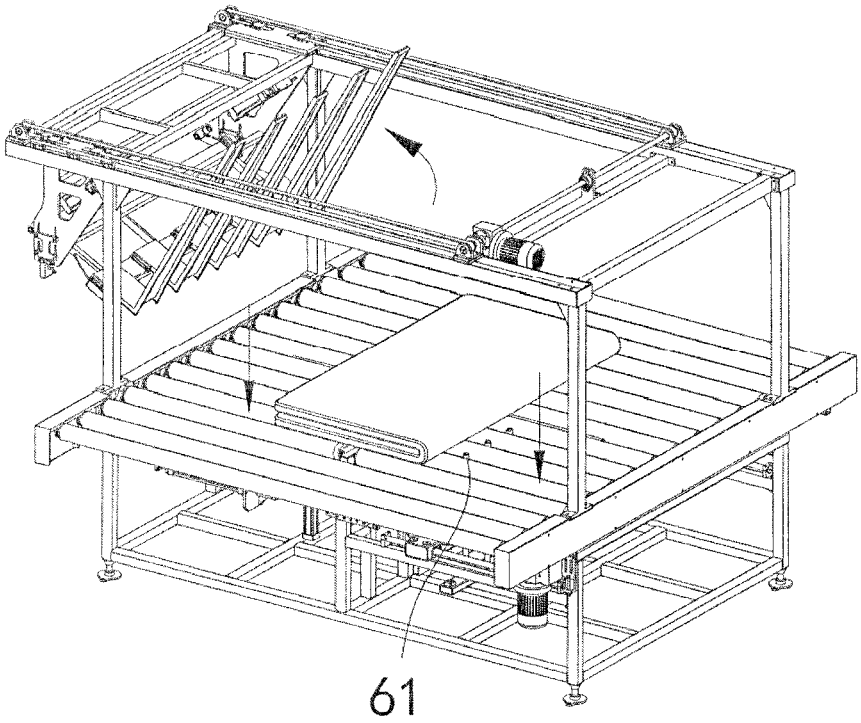
FIG. 10 is a schematic diagram showing an eighth state in the process of folding the mattress by the cushion conveying device according to an embodiment of the disclosure.
Figure 11:
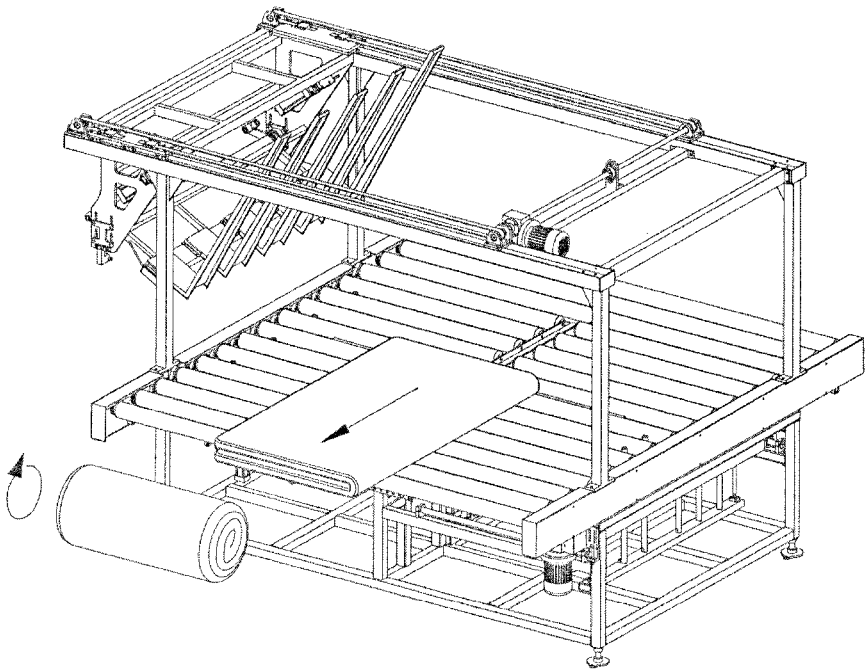
FIG. 11 is a schematic diagram showing a ninth state in the process of folding the mattress by the cushion conveying device according to an embodiment of the disclosure.
Figure 12:
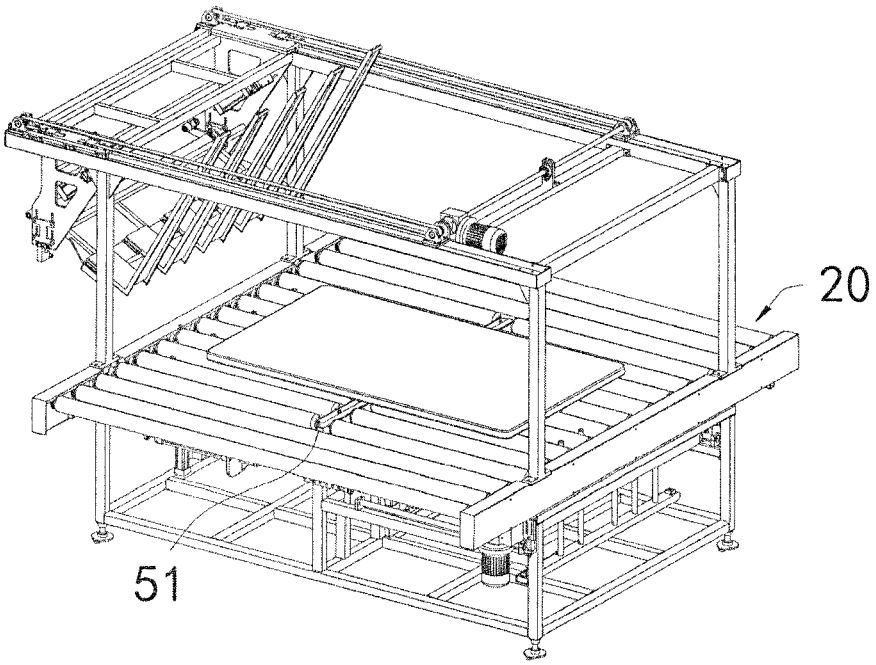
FIG. 12 is a schematic diagram showing a first state in the process of rotating a mattress by the cushion conveying device according to an embodiment of the disclosure.
Figure 13:
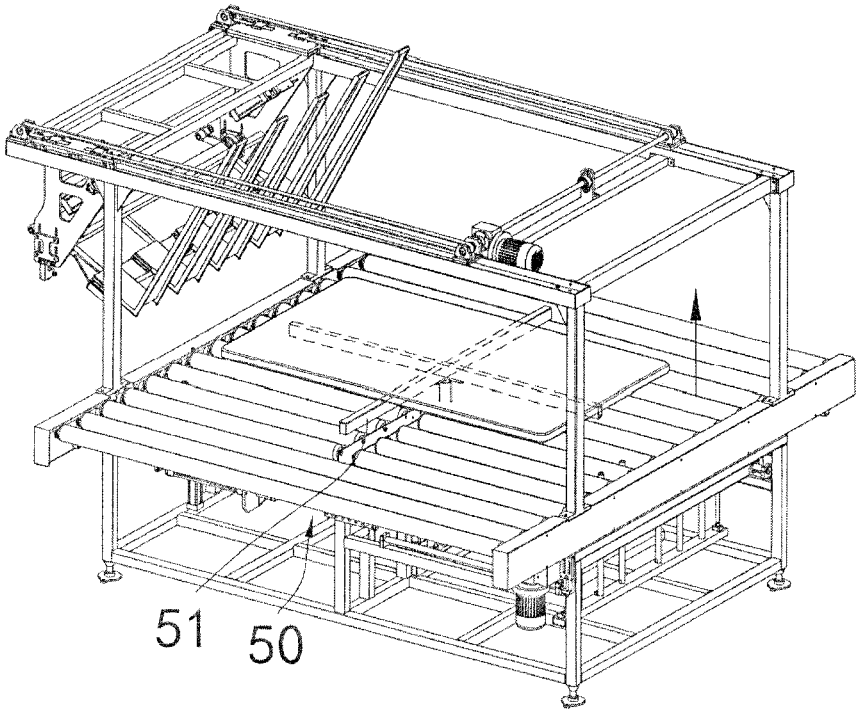
FIG. 13 is a schematic diagram showing a second state in the process of rotating the mattress by the cushion conveying device according to an embodiment of the disclosure.
Figure 14:
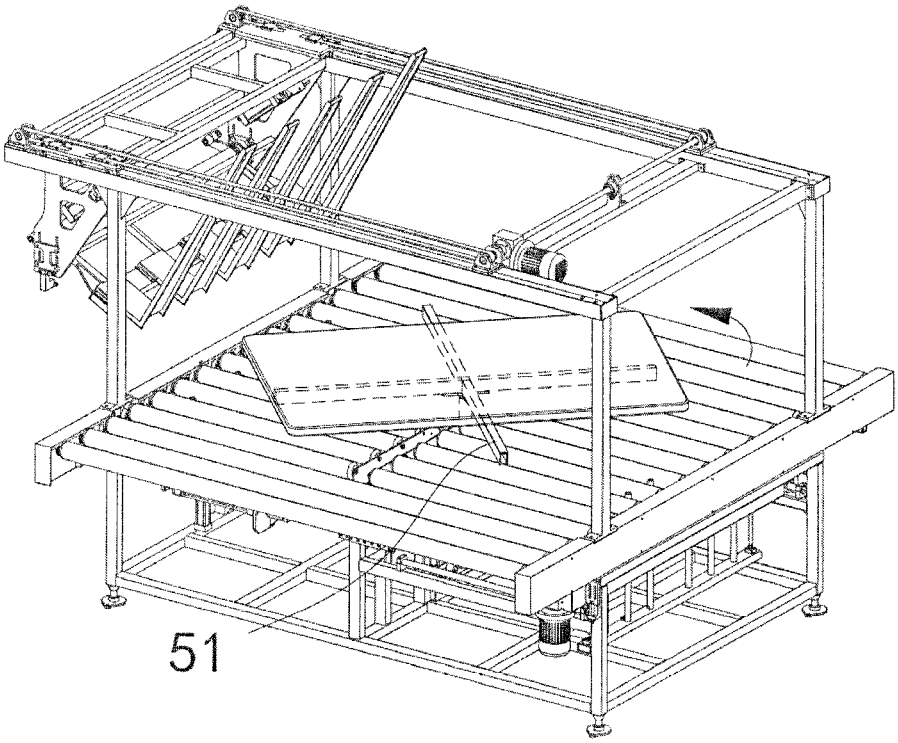
FIG. 14 is a schematic diagram showing a third state in the process of rotating the mattress by the cushion conveying device according to an embodiment of the disclosure.
Figure 15:
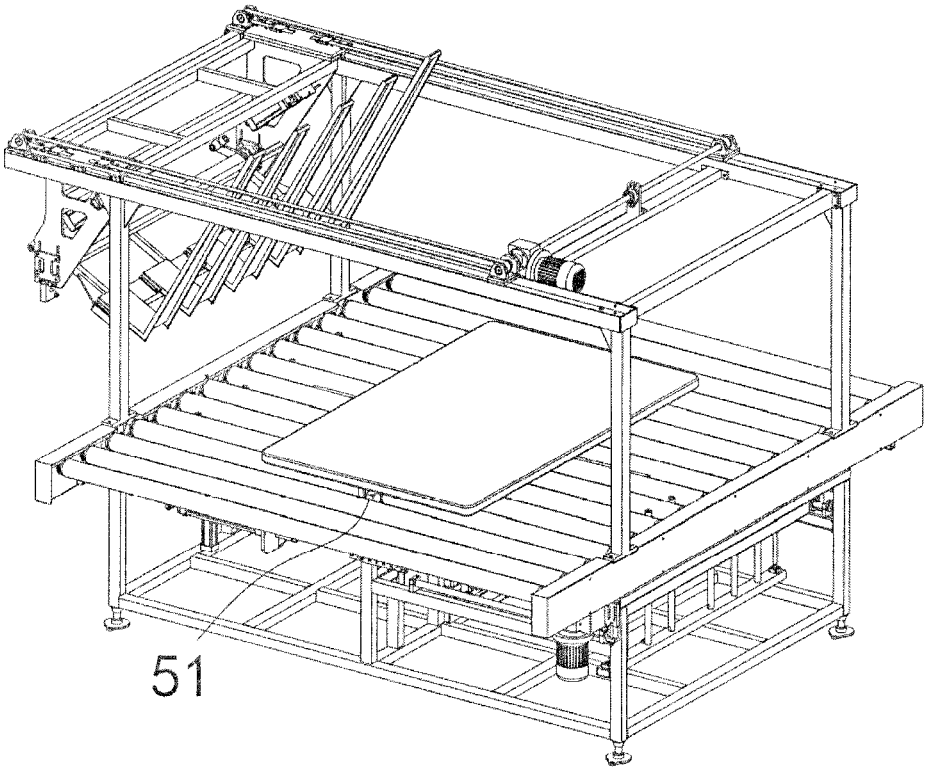
FIG. 15 is a schematic diagram showing a fourth state in the process of rotating the mattress by the cushion conveying device according to an embodiment of the disclosure.
Figure 16:
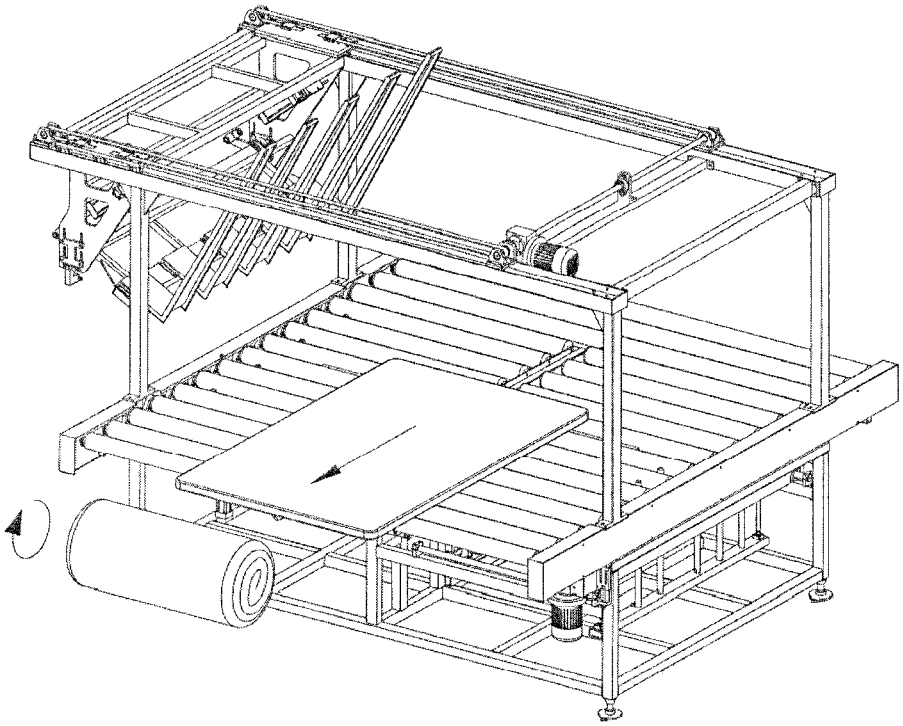
FIG. 16 is a schematic diagram showing a fifth state in the process of rotating the mattress by the cushion conveying device according to an embodiment of the disclosure.

Referring to FIG. 2, in an alternative embodiment, a slide rail 32 is arranged on a left side of the frame 10. The slide rail is approximately in the same plane as the conveying platform 20 and arranged in a left-right direction. The slide rail 32 is slidably connected with a slide base 33, which is translatable back and forth along a direction of the slide rail 32 when driven by a motor, a chain sprocket transmission mechanism, etc. A top of the slide base 33 is hinged with a bottom of the pressing member 31, forming a hinge axis. The pressing member 31 is rotatable for a predetermined angle about the hinge axis with respect to the slide base 33, that is, swingable up and down about the hinge axis, when driven by components such as a cylinder. The pressing member 31 includes a plurality of pressing plates in a flat state arranged at intervals. Similarly, the mattress can be pressed by swinging the pressing member 31 down to the lowest point, and the pressing member 31 can be pulled out and separated from the folded mattress by horizontal translation of the pressing member 31 to the left.

In some embodiments, the pressing plates of the pressing member 31 arranged at intervals may be replaced with rollers arranged at intervals.

The folding mechanism 40 is arranged on the frame 10 below the conveying platform 20. When one part of the mattress is pressed by the pressing mechanism 30, the folding mechanism 40 acts on the other part of the mattress to turn up and fold the mattress. In this embodiment, the mattress is conveyed to a middle position of the conveying platform 20, and the pressing mechanism 30 presses a left part of the mattress. The folding mechanism 40 includes a folding member 41 formed by a plurality of turning plates or rods which are swingable back and forth, and each of the turning plates or rods is arranged in a respective one of the gap areas and located on a right side of the conveying platform 20. One end of the folding member 41 is hinged to a position below the conveying platform 20. When driven by components such as a motor or a cylinder, the folding member 41 swings upward, and the other end of the folding member is capable of extending upward through the gap areas and moving above the middle or left side of the conveying platform 20, so as to abut against a bottom surface of a right side of the mattress to fold the left and right parts of the mattress towards each other.

Referring to FIGS. 12 to 16, in some embodiments, the cushion conveying device further includes a rotating mechanism 50 for rotating the mattress on the conveying platform 20, so as to adjust orientation of the mattress. For example, for a mattress with a small width, it does not need to be folded and may be directly rolled up for packaging. In this case, only the orientation of the mattress needs to be adjusted to make the length direction of the mattress consistent with the conveying direction of the mattress. In some embodiments, the rotating mechanism 50 includes a support plate 51 arranged in the gap area, a lifting member capable of driving the support plate 51 to move up and down, and a rotating member for driving the support plate 51 to rotate. In some embodiments, the support plate 51 is connected at a center with a rotating shaft, which is rotationally connected to a lifting platform below the conveying platform 20. The rotating shaft may be driven by a motor to rotate for a predetermined angle, thus driving the support plate 51 to rotate for a predetermined angle, generally 90 degrees. The lifting platform moves up and down as a whole by a cylinder, so that the support plate 51 can move up and down. Upward movement of the support plate 51 can support and lift the mattress, so that the bottom surface of the mattress is separated from the conveying platform 20. The support plate 51 rotates to drive the mattress to rotate for orientation adjustment. Then, the support plate 51 moves downward to reset, and the mattress falls on the conveying platform 20 again. In some embodiments, the support plate 51 is a cross-shaped plate, or a window-shaped plate which is defined as including four square windows arranged into two rows and two columns, which is easy to pass through the gap area, has simple and compact structure, and is also easy to support and lift the mattress as a whole.

The folding mechanism 40 and the rotating mechanism 50 are both arranged at the conveying platform 20, that is, the folding process of the mattress by the folding mechanism 40 and the rotating process of the mattress by the rotating mechanism 50 are integrated together. According to the actual conveying situation of the mattress, the folding mechanism 40 or the rotating mechanism 50 may be flexibly and selectively driven to fold the mattress with a large width or rotate the mattress with a small width. The whole device has compact structure and small occupied space, and also improves the applicability of mattress packaging, and can be applied to mattresses with different widths.

In some embodiments, the cushion conveying device further includes a centering mechanism 60 for adjusting left and right positions of the mattress on the conveying platform 20, so as to facilitate connection and cooperation with a subsequent process, especially when the mattress is turned up and folded in half, the whole mattress is on the left side of the conveying platform 20. The centering mechanism 60 includes centering members 61 respectively arranged on the left and right sides of the conveying platform 20. The centering members 61 on both sides are movable towards each other, which means that the centering members 61 on both sides are movable towards a middle direction. The centering members 61 on both sides contact the mattress and push the mattress in a folded state, thus moving the mattress to the middle position of the conveying platform.

In some embodiments, the centering members 61 on both sides are a plurality of retaining rods, which are respectively arranged in corresponding gap areas on the left and right sides. The centering members 61 are movable back and forth in the left-right direction in the gap areas through existing common components such as a motor or a cylinder, realizing that the centering members 61 on both sides can move toward or away from each other, thus pushing the mattress for position adjustment.

In some embodiments, the retaining rods may be provided as a telescopic structure. When the retaining rods move downward to retract relative to the conveying platform 20, the retaining rods are all located below the conveying platform 20. When the retaining rods are needed to push the mattress to adjust the left and right position of the mattress, the retaining rods move upward to extend relative to the conveying platform 20, and then the retaining rods on both sides move toward each other to push the mattress to move to the middle position of the conveying platform 20. The telescopic structure of the retaining rods makes the whole structure more compact, thereby making full use of the space below the conveying platform.

Referring to FIG. 3 to FIG. 11, the process of folding and conveying a mattress with a large width by the cushion conveying device may be described as follows.

The mattress enters the conveying platform 20. The pressing member 31 moves to the right under the action of the slide rail 32 and the slide base 33, and swings downward to press the left part of the mattress. The folding member 41 is turned up to pass through the gap area and abut against the right part of the mattress, and the right part of the mattress is turned to the left side to be folded in half. The folding member 41 swings downward and returns to a position below the conveying platform 20 to reset. Meanwhile, the centering members 61 on the left and right sides move upward to extend. The pressing member 31 translates to the left, so as to be gradually pulled out and separated from the folded mattress. Meanwhile, the centering members 61 on the left and right sides move towards each other to push the folded mattress to the middle position. The pressing member 31 swings upward and turns up after being completely separated from the folded mattress. Meanwhile, the centering members 61 on the left and right sides move downward to retract. The conveying platform 20 conveys the folded mattress to the next process.

Referring to FIG. 12 to FIG. 16, the process of rotating and conveying a mattress with a small width by the cushion conveying device may be described as follows.

The mattress enters the middle position of the conveying platform 20. The support plate 51 moves upward to lift the mattress. The support plate 51 rotates to drive the mattress to rotate for 90 degrees, so that the length direction of the mattress is consistent with the conveying direction of the mattress. The support plate 51 moves downward to reset so that the mattress falls on the conveying platform 20. The conveying platform 20 conveys the rotated mattress to the next process.

According to an embodiment of the disclosure, there is provided a cushion conveying method for folding and conveying a mattress by the cushion conveying device described above, especially for a mattress with a large width, which includes the following steps:

- conveying the mattress into the conveying platform, where the mattress is conveyed transversely, that is, the length direction of the mattress is perpendicular to the conveying direction of the mattress;
- pressing by the pressing mechanism at least one part of the mattress;
- turning up by the folding mechanism the other part of the mattress to turn up and fold the mattress;
- pushing by the centering mechanism the folded mattress to a middle position;
- conveying the mattress out of the conveying platform to enter a next process.

According to an embodiment of the disclosure, there is provided a cushion conveying method for rotating and conveying a mattress by the cushion conveying device described above, especially for a mattress with a small width, which includes the following steps:

- conveying the mattress into the conveying platform, where the mattress is conveyed transversely, that is, the length direction of the mattress is perpendicular to the conveying direction of the mattress;
- rotating by the rotating mechanism the mattress for 90 degrees;
- conveying the mattress out of the conveying platform to enter a next process.

Figure 17:
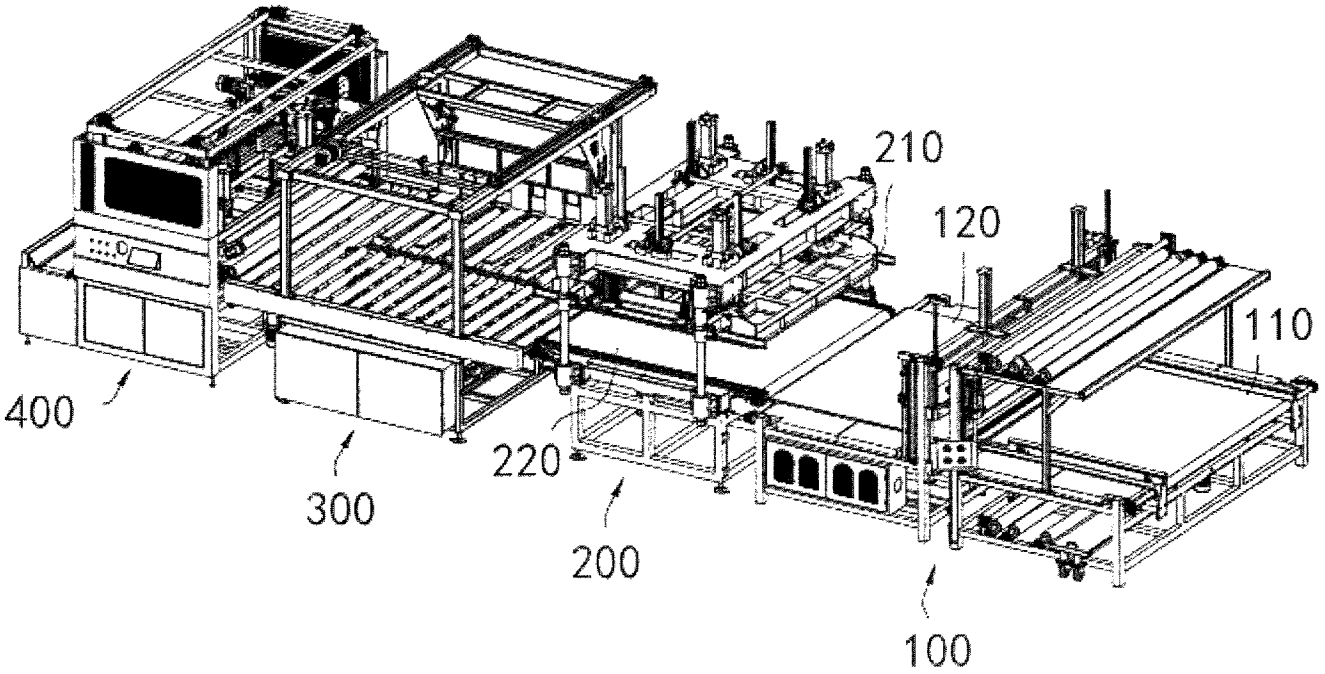
FIG. 17 is a schematic structural diagram of a cushion rolling packaging apparatus according to an embodiment of the disclosure.
Figure 19:
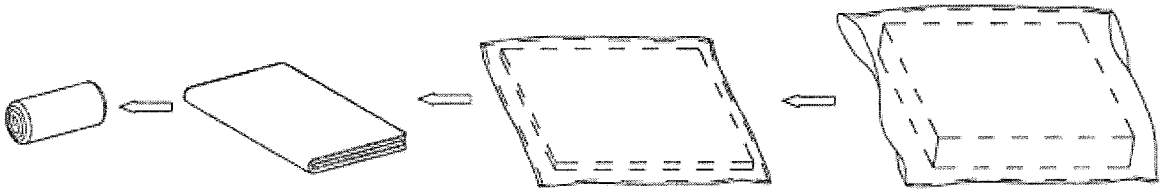
FIG. 19 is a schematic structural diagram of a cushion rolling packaging method according to an embodiment of the disclosure.

Referring to FIG. 17 and FIG. 19, according to an embodiment of the disclosure, there is provided a cushion rolling packaging apparatus, by which a mattress can be rolled and packaged in the form of a production line to form a cylindrical shape, so as to reduce the occupied space of the mattress during transportation and storage.

The cushion rolling packaging apparatus according to the embodiment of the disclosure includes a film covering packaging device 100, a compression packaging device 200, a cushion conveying device 300 and a rolling packaging device 400 which are arranged in sequence according to a conveying direction of a mattress, where the film covering packaging device 100 is arranged at the most upstream position and the rolling packaging device 400 is arranged at the most downstream position. The terms upstream and downstream are defined according to the conveying direction of the mattress.

Figure 18:
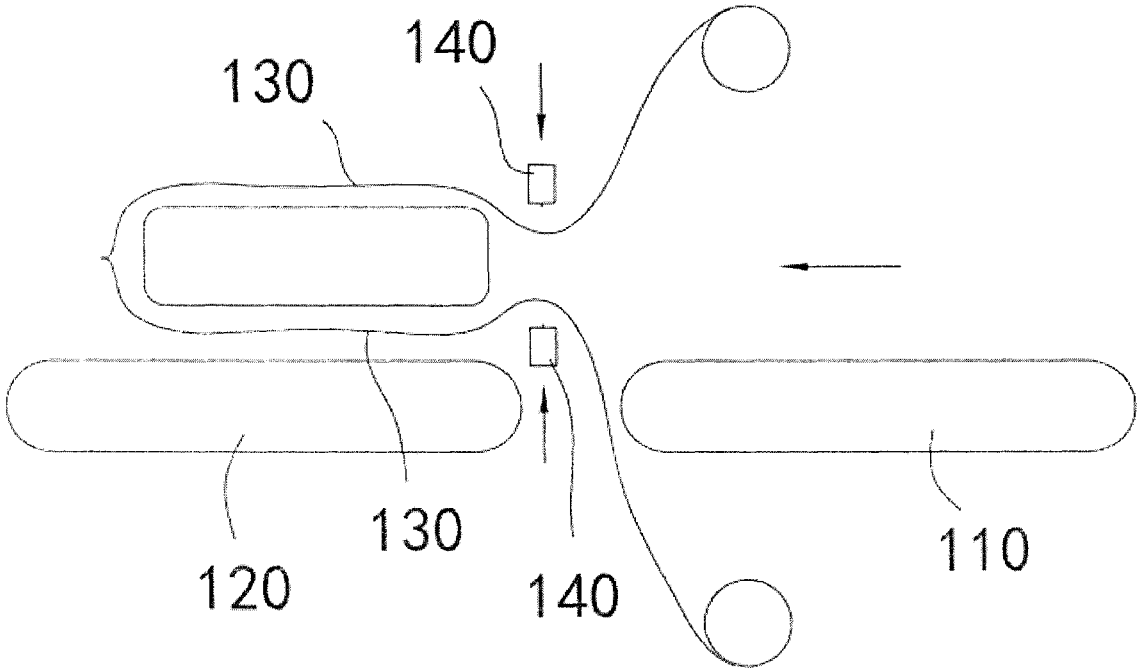
FIG. 18 is a schematic structural diagram of a film covering packaging device in the cushion rolling packaging apparatus according to an embodiment of the disclosure.

The film covering packaging device 100 may be a conventional film covering packaging device for covering upper and lower end faces of the mattress with a packaging material, such as a film 130. Referring to FIG. 18, in this embodiment, the film covering packaging device 100 includes a first conveying platform 110 and a second conveying platform 120 arranged in a front-back direction. The mattress is conveyed from the first conveying platform 110 to the second conveying platform 120, an upper and lower films 130 cover the upper and lower end faces of the mattress respectively. The two films are welded and cut by a welding packaging and cutting mechanism 140, and the mattress is wrapped by leaving openings on the left and right sides, and then conveyed to the compression packaging device 200.

The compression packaging device 200 is configured to compress and flatten the mattress to discharge air from the mattress, and then seals the openings on the left and right sides by welding, so that a sealed state is formed in the films. The compression packaging device 200 may be a conventional compression packaging device. In this embodiment, the compression packaging device 200 includes an upper platform 210 and a lower platform 220. The lower platform 220 is a conveyor belt, the upper platform is movable up and down. When the mattress moves onto the lower platform 220, the upper platform 210 moves down to compress and flatten the mattress. Left and right sides of the upper platform 210 and the lower platform 220 are respectively provided with a welding packaging mechanism for welding and sealing the openings of the films after the mattress is compressed, so that a vacuum state is formed in the films, and then the compressed and sealed mattress is conveyed to the cushion conveying device 300.

The cushion conveying device 300 is the cushion conveying device described above, which folds or rotates the compressed and sealed mattress. The folding or rotating process of the mattress is described above, and will not be repeated here.

The rolling packaging device 400 may be a common rolling packaging device, as long as it can roll the mattress into a cylindrical shape, such as the mandrel-free cushion rolling packaging machine disclosed in patent CN201193114Y, which rolls the folded or rotated mattress into a cylindrical shape.

Referring to FIG. 17 and FIG. 19, according to an embodiment of the disclosure, there is provided a cushion rolling packaging method, which is implemented by the cushion conveying device, and includes the following steps:

- covering by the film covering packaging device a film on a surface of a mattress, and conveying the mattress to the compression packaging device;
- compressing by the compression packaging device the mattress to discharge air, sealing and packaging the mattress in the film, and conveying the mattress to the cushion conveying device;

folding or rotating by the cushion conveying device the mattress, and conveying the mattress to the rolling packaging device;

rolling by the rolling packaging device the mattress into a cylindrical shape and conveying the mattress out of the rolling packaging device.

The embodiments of the disclosure have been described in detail with reference to the accompanying drawings, but the disclosure is not limited to the above embodiments, and various changes may be made within the knowledge of those having ordinary skill in the art without departing from the purpose of the disclosure.

What is claimed is:

1. A cushion conveying device, comprising:

a frame;

a conveying platform arranged on the frame for conveying a cushion, wherein at least one gap area is provided on the conveying platform;

a pressing mechanism arranged above the conveying platform or on one side of the conveying platform, wherein the pressing mechanism is movable back and forth to contact and press at least one part of the cushion on the conveying platform; and a folding mechanism arranged below the conveying platform, wherein the folding mechanism comprises at least one folding member movable back and forth to pass through the at least one gap area, the at least one folding member is capable of extending out of the at least one gap area to abut against the cushion on the conveying platform, so as to turn up and fold the cushion;

wherein the pressing mechanism comprises at least one pressing member and a driving component for driving the at least one pressing member to translate and/or rotate, and the driving component is capable of driving the at least one pressing member to separate from the cushion after the cushion is turned up and folded;

wherein the pressing mechanism comprises a slide rail arranged on the frame and a slide base slidably connected with the slide rail, the at least one pressing member is hinged with the slide base, and the driving component is capable of driving the slide base to translate relative to the slide rail and/or driving the at least one pressing member to rotate relative to the slide base.

2. The cushion conveying device of claim 1, wherein the at least one pressing member comprises a plurality of pressing plates and/or rollers which are arranged at intervals.

3. The cushion conveying device of claim 1, wherein the at least one pressing member is configured to press half of the cushion on the conveying platform.

4. The cushion conveying device of claim 1, wherein the at least one folding member comprises a turning plate or rod swingable to pass through the at least one gap area.

5. The cushion conveying device of claim 1, further comprising:

a rotating mechanism comprising a support plate arranged in the at least one gap area, a lifting member capable of driving the support plate to move up and down, and a rotating member for driving the support plate to rotate.

6. The cushion conveying device of claim 5, wherein the support plate is cross-shaped or window-shaped.

7. The cushion conveying device of claim 1, further comprising:

a centering mechanism comprising centering members respectively arranged on left and right sides of the conveying platform, wherein the centering members on both sides are movable towards each other to push the cushion to a middle position of the conveying platform.

8. The cushion conveying device of claim 7, wherein the centering members comprise retaining rods movable back and forth in the at least one gap area.

9. The cushion conveying device of claim 8, wherein the retaining rods are movable up and down so as to extend or retract relative to the conveying platform.

10. The cushion conveying device of claim 1, wherein the conveying platform comprises a plurality of rollers arranged in sequence, and the at least one gap area is formed by a gap between adjacent rollers.

11. The cushion conveying device of claim 1, wherein the conveying platform comprises a plurality of conveyor belts arranged in sequence, and the at least one gap area is formed by a gap between adjacent conveyor belts.

12. A cushion conveying method, implemented by the cushion conveying device of claim 1, and comprising:

conveying a cushion into the conveying platform;

pressing by the pressing mechanism at least one part of the cushion;

turning up by the folding mechanism another part of the cushion to turn up and fold the cushion; and conveying the cushion out by the conveying platform.

13. The cushion conveying method of claim 12, further comprising:

pushing the cushion to a middle position after turning up and folding the cushion.

14. The cushion conveying method of claim 12, wherein the conveying of the cushion into the conveying platform comprises: conveying the cushion into the conveying platform with a length direction of the cushion being perpendicular to a conveying direction of the cushion.

15. A cushion conveying method, implemented by the cushion conveying device of claim 5, and comprising:

conveying a cushion into the conveying platform;

rotating by the rotating mechanism the cushion for 90 degrees; and conveying the cushion out by the conveying platform.

16. The cushion conveying method of claim 15, wherein the conveying of the cushion into the conveying platform comprises: conveying the cushion into the conveying platform with a length direction of the cushion being perpendicular to a conveying direction of the cushion.

17. A cushion rolling packaging apparatus, comprising the cushion conveying device of claim 1, a rolling packaging device arranged downstream of the cushion conveying device, a compression packaging device arranged upstream of the cushion conveying device, and a film covering packaging device arranged upstream of the compression packaging device.

18. A cushion rolling packaging method, implemented by the cushion rolling packaging apparatus of claim 17, and comprising:

covering by the film covering packaging device a film on a surface of a cushion, and conveying the cushion to the compression packaging device;

compressing by the compression packaging device the cushion to discharge air, sealing and packaging the cushion in the film, and conveying the cushion to the cushion conveying device;

folding or rotating by the cushion conveying device the cushion, and conveying the cushion to the rolling packaging device;

rolling by the rolling packaging device the cushion into a cylindrical shape and conveying the cushion out of the rolling packaging device.

* * * * *